United States Patent [19]

Popoff et al.

[11] 4,131,622

[45] Dec. 26, 1978

[54] PURIFICATION OF N,N'-DISUBSTITUTED p-PHENYLENEDIAMINE ANTIOZONANTS AND OIL STABILIZERS

[75] Inventors: Ivan C. Popoff, Ambler; Paul G. Haines, Lafayette Hill, both of Pa.

[73] Assignee: Pennwalt Corporation, Philadelphia, Pa.

[21] Appl. No.: 798,186

[22] Filed: May 18, 1977

Related U.S. Application Data

[63] Continuation of Ser. No. 343,778, Mar. 22, 1973, abandoned.

[51] Int. Cl.[2] ..... C07C 85/26

[52] U.S. Cl. ..... 260/576; 260/566 F; 260/577

[58] Field of Search ..... 260/566 F, 576, 577, 260/582

[56] References Cited

U.S. PATENT DOCUMENTS 3,014,967 12/1961 Chapman ..... 260/576

*Primary Examiner*—Winston A. Douglas
*Assistant Examiner*—John Doll
*Attorney, Agent, or Firm*—Plumley and Tyner

[57] ABSTRACT

Process for purifying N,N'-disubstituted p-phenylenediamine antiozonants and oil stabilizers utilizes a steam-distillation step to remove Schiff's base derivatives of p-phenylenediamine and N-monosubstituted p-phenylenediamine as well as aldehyde and ketone contaminants and corresponding alcohols thereof.

3 Claims, No Drawings

PURIFICATION OF N,N'-DISUBSTITUTED P-PHENYLENEDIAMINE ANTIOZONANTS AND OIL STABILIZERS

This is a continuation, of application, Ser. No. 343,778, filed Mar. 22, 1973, now abandoned.

This invention relates to a process for preparing substantially pure N,N'-dialkyl, and N-alkyl-N' aryl disubstituted p-phenylenediamine antiozonants and oil stabilizers, and more particularly relates to a method for quality upgrading of such products by economical removal of contaminants.

The p-phenylenediamine-type compounds are widely used in the rubber industry as age resistors and for the protection of natural and synthetic elastomers against ozone, especially under dynamic conditions. These compounds are also useful as additives for oil and gasoline wherein they act as stabilizers.

A typical commerical process for the preparation of N,N'-disubstituted p-phenylenediamines is the reductive alkylation of p-phenylenediamine or N-monosubstituted p-phenylenediamines with excess of aldehydes or ketones. Examples of the foregoing preparations using a platinum type catalyst are shown in U.S. Pat. No. 3,336,386 and with a nickle type catalytic system are described in U.S. Pat. No. 3,366,684.

Although the alkylation actually comprises two chemical reactions, the first being the formation of a Schiff's base and the second the hydrogenation of the Schiff's base, for economical reasons the reaction is performed as a "one step" process without isolating the intermediates and without removing all byproducts or residual amounts of reactants. That is along with the N,N' 1-disubstituted p-phenylenediamine product, there are present small amounts of unreacted p-phenylenediamine or N-monosubstituted p-phenylenediamine, aldehyde or ketone whichever is the case, mono- and di-Schiff's base and alcohol. The final product is usually isolated as distillation residue of the reaction mixture by stripping off the water and alcohol formed as byproducts and the excess ketone or aldehyde.

Extensive removal of contaminants, especially those of moderately high boiling points, such as the Schiff's bases, by vacuum distillation is necessarily quite expensive. That is, vacuum distillation would result in the removal of large amounts of useful product at a relatively slow rate of distillation. In contradistinction, a distillation at atmospheric pressure, which is more favorable for separation of products having close boiling points, would require higher temperatures and hence produce still additional contamination by cracking. Purification by crystallization is entirely out of the question for all practical purposes because of the excessive costs involved.

In the utilization of the N,N'-disubstituted p-phenylenediamines, a substantially pure product is frequently not only desirable but necessary as when further halding steps are required as when used as an oil additive or as an antiozonant. In the case of the use of these materials in a liquid state as oil additives, contaminants can cause relatively rapid change in oil viscosities. In the case of solid antiozonants which are to be compounded into nervy rubber elastomers on a mill or internal mixer, it is preferable that such materials be in a free-flowing flake form so as to facilitate economical and safe handling. Contamination in N,N'-disubstituted p-phenylenediamine materials having a melting points approximately twenty to forty degrees above ambient temperature, for example N-(1,3 dimethylbutyl)-N'-phenyl-p-phenylenediamine (m.p. 50–52° C, b.p. 380° C), so depresses the melting point of these products that a semisolid mushy consistency is effected at ordinary temperatures, thereby presenting difficulty in economical weighing and application accuracy and in avoiding material losses. As a consequence, the caked mushy masses must be warmed or kept warm to a point that they can be utilized in a liquid state as an antiozonant. In the case of the use of these materials in a liquid state as oil additives, contamination can cause relatively rapid change in oil viscosity. That is, Schiff's bases are quite sensitive to hydrolysis under normal storage conditions and thus may be the source of relatively low boiling carbonyl compounds. The latter could for example cause not only undesirable changes in oil viscosities but also contribute to the formation of bubbles during the curing procedure of elastomers. Furthermore, in the case of solid antiozonants which are to be compounded into rubberlike elastomers on a mill or in an internal mixer, it is preferable that these additives be in a free-flowing flake form to facilitate handling.

It is therefore an object of this invention to provide an improved method for making substantially pure, N,N'-disubstituted p-phenylenediamine from contaminated products thereof containing Schiff's base derivatives of p-phenylenediamine and N-monosubstituted p-phenylenediamine.

Other objects of this invention are to provide an improved method of the character described which is easily and economically accomplished and both highly efficient and effective in operation.

The reactions which produce the material to which the present invention relates may be represented by equations A and B:

A.

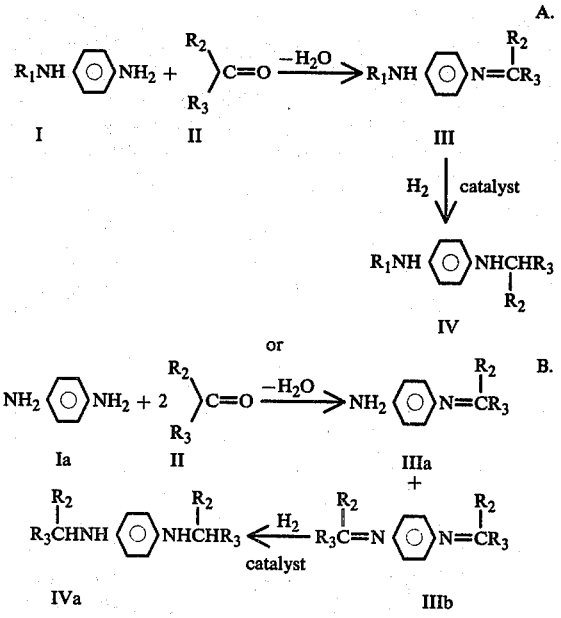

where $R_1$ is an aliphatic or aromatic group, $R_2$ is an aliphatic group or hydrogen and $R_3$ is an aliphatic group.

No attempt is made herein to list all of the specific examples of operative reactants i.e. p-phenylenediamine (Ia) or N'-monosubstituted p-phenylenediamine (I) and aldehydes and ketones (II) of from about 2 to 18 carbons or of the N,N'-disubstituted p-phenylenediamine products (IV) or (IVa) which result. It is sufficient to indicate that excess aldehyde or ketone (II) is utilized in the reaction and that mono-Schiff's bases (III) or (IIIa) or di-Schiff's bases (IIIb) are the product contaminants which the process of the present invention encompasses.

The Schiff's base (III, III-a or III-b, see equations A and B) can be present in the final reaction mixture not only by virtue of incomplete hydrogenation at the time the hydrogenation is discontinued but also and especially due to a subsequent Schiff's base formation under the relatively favorable conditions of the last phase of the process. In the "one step" process for manufacturing of IV or IV-a, the water formed is not removed from the reaction mixture until the hydrogen pressure is relieved, thus until the hydrogenation is discontinued. The presence of water, however, is detrimental to the exhaustive conversion of I or I-a to Schiff's bases III, III-a or III-b. Thus some unreacted I (or I-a) is present in the reaction mixture subsequently subjected to the stripping operation at elevated temperature to distill off the water and alcohol formed as well as the excessive carbonyl reactant II, $R_2R_3C(O)$. This operation facilitates an additional Schiff's base formation by the reaction of thusfar unreacted I or I-a with the carbonyl compound II which is used in excess. The Schiff's base formed at this stage of the process remains in the distillation residue representing the crude product.

The following examples are given to illustrate the invention:

EXAMPLE I

A mixture of 500g. (5 moles) 4-methyl-2-pentanone and 184 g. (1 mole) N-phenyl-p-phenylenediamine containing 10 g. copper chromite catalyst was reacted at 150°-160° C and 1000 psi hydrogen pressure until the hydrogen uptake became very slow. After filtering off the catalyst and topping off the filtrate at 100 mm. and 100° C, 208 g. still pot residue of crude product N-(1,3-dimethylbutyl)-N'-phenyl-p-phenylenediamine was obtained, while the excess 4-methyl-2-pentanone, and the water and 4-methyl-2-pentanol byproducts were stripped off; no attempt was made to isolate the Schiff's base III [$R_1$=$C_6H_5$, $R_2$=$CH_3$, $R_3$=—$CH_2CH(CH_3)_2$]. The antiozonant product N-(1,3-dimethylbutyl)-N'-phenyl-p-phenylenediamine (IV) [$R_1$=$C_6H_5$, $R_2$=$CH_3$, $R_3$=$CH_2CH(CH_3)_2$] was soft and mushy, melting at 43°-50° C; when a sample of this product was kept at 46°-47° C. for one hour, most of the sample liquefied, and when held for 23 hours at 40°-42° C. or for 3.3 hours at 44°-45° C, much of it melted.

EXAMPLE 2

A 150 g. portion of the product of Example I was subjected to steam-distillation by way of superheated (180° C) steam-stripping. The still pot temperature was 102° C. at the start of the steam-stripping and 175° C. when terminated. A total of 161 g. aqueous distillate containing 4-methyl-2-pentanone was collected. The product residue weighed 147.6 g. (1.6% removed) and the melting range was 48°-50° C. This product is easily flaked and the flakes retained their form for 23 hours at 40°-42° C., or for at least 3.3 hours at 44°-45° C. or for at least 1 hour at 46°-47° C.

EXAMPLE 3

Another 150 g. sample of the product of Example 1 was subjected to 180° C. superheated steam-stripping as in Example 2 until a total of 500 g. of aqueous distillate was collected. The distillate contained 4 g. of an oil layer, part of which was identified by infra-red analysis as 4-methyl-2-pentanone. The still pot residue product weighed 145.8 g. (2.8% removed) and the melting range thereof was 48°-50° C. The steam-stripped product residue was easily flaked, and exhibited substantially the same aging characteristics as the product residue under Example 2.

EXAMPLE 4

Still another 150 g. sample of the product obtained by way of Example 1 was subjected to superheated steam-stripping at 180° C., as described in Example 2, until 864 g. distillate containing 4-methyl-2-pentanone was collected. The still pot residue product weighed 140.3g. (6.5% removed), and the melting range of the product was 48°-50° C. The product was easily flaked and exhibited the same aging characteristics as that of Example 3.

A summary of the physical characteristics after aging of N-(1,3-dimethylbutyl)-N'-phenyl-p-phenylenediamine obtained commercially in crude form as product IV[$R_1$=$C_6H_5$, $R_2$=$CH_3$, $R_3$=$CH_2CH(CH_3)_2$] compared with purified flaked product IV following steam-stripping in accordance with this invention is shown in Table I below:

TABLE I

Aging of Crude Commercial and Purified Flaked IV[$R_1$ = $C_6H_5$, $R_2$ = $CH_3$, $R_3$ = $CH_2$ $CH(CH_3)_2$]

| Temperature ° C. | Time Hours | Commercial IV m.p. 45-50° C. | 1.6% Steam-Stripped Flaked IV | 2.8% Steam-Stripped Flaked IV | 6.5% Steam-Stripped Flaked IV |
|---|---|---|---|---|---|
| 40-42 | 23.0 | Partly melted, partly caked. | Free Flowing, slightly caked. | Free Flowing, slightly caked. | Free Flowing, slightly caked. |
| | 3.0 | Some melting and caking | — | Free Flowing. no caking. | |
| 44-45 | 3.3 | Partly melted, partly caked. | Free Flowing, slightly caked. | Free flowing, slightly caked. | Free Flowing, slightly caked. |
| 46-47 | 1.0 | Mostly melted, the remainder caked. | Free flowing, slightly caked. | Free flowing, slightly caked. | Free flowing, slightly caked. |

When a sample of the N-(1,3-dimethylbutyl)-N-phenyl-p-phenylenediamine (product IV) purified in accordance with Example 3 was contaminated with 5% by weight of Schiff's base III, i.e. N-(1,3-dimethylbutylidene)-N-phenyl-p-phenylenediamine the resulting mixture had a m.p. 46°-49° C. After storage for seven days at room temperature (20°-25° C.) and high humidity, the m.p. range of the contaminated product widened to 42°-47° C. When a sample of the foregoing purified product IV was contaminated with 5% by weight of Schiff's base as above, the mixture caked-up after 3 hours at 40°–42° C. As may be seen from Table II below, this behavior is characteristic of the unpurified form of commercially available material IV [$R_1$=$C_6H_5$, $R_2$=$CH_3$, $R_3$=$CH_2CH(CH_3)_2$]. A mixture of 95% of purified product IV, prepared in accordance with Example 3, to which 5% of N-phenyl-p-phenylenediamine [(I) $R_1$=$C_6H_5$] had been added, had a m.p. 48°–50° C. which did not change appreciably after storage for seven days at a temperature of 20°–25° C. and high humidity.

The foregoing results indicate that contamination of the product with Schiff's base is undesirable in solid antiozonants.

TABLE II

Aging at 40–42° C. of Blend IV (2.8% steam-stripped) with III [$R_1$ = $C_6H_5$, $R_2$ = $CH_3$, $R_3$ = $CH_2CH(CH_3)_2$]

| Time in hrs. at 40–42° C | Commercial IV (melting range, 43–50° C) | 2.8% Steam Stripped IV (Melting range 49–52° C.) | Blend of 95% of 2.8% Steam Stripped IV with 5% of III (Melting range, 47–50° C) |
|---|---|---|---|
| 2 | Moderately caked, ketone odor | Not caked, free flowing, No ketone odor | Moderately caked; ketone odor |
| 3 | Moderately caked, ketone odor. | Not caked, free flowing No ketone odor. | Extensively caked; ketone odor. |

EXAMPLE
5-N,N'-bis(1-methylheptyl)-p-phenylenediamine

A mixture of 1024 g. (8 moles) of 2-octanone and 108 g. (1 mole) p-phenylenediamine was reacted and worked up in the same manner as set forth generally in Example 1 to yield 333 g. (100%) crude N, N'-bis(1-methylheptyl)-p-phenylenediamine product [IVa, $R_2$=$CH_3$, $R_3$=$CH_2(CH_2)_4CH_3$].

A 150 g. portion of the product was steam-stripped with superheated steam at 150° C. in the manner of that of Example 3 leaving a liquid still pot residue of 145.5 g. (3% removed). The small oil layer of the distillate contained 2-octanone. The complete removal of the Schiff's base can be accomplished by continuing the steam distillation until no more 2-octanone co-distills.

EXAMPLE
6-N,N'-bis(1-ethyl-3-methylpentyl-p-phenylenediamine

A mixture of 768 g. (6 moles) 5-methyl-3-heptanone and 108 g. (1 mole) p-phenylenediamine was reacted and worked up in the same manner as that of Example 1 to give 330 g. (99%) residue of crude N,N'-bis(1-ethyl-3-methylpentyl)-p-phenylenediamine product [IVa, $R_2$=$C_2H_5$, $R_3$=$CH_2CH(CH_3)C_2H_5$] containing some mono-Schiff's base III-c and some di-Schiff's base III-d.

A 150 g. portion of the product was stripped with superheated steam (130° C) in the manner of that of Example 3 to leave a still pot residue of 144.2 g. liquid (3.9% removed). The small oil layer of the distillate contained 5-methyl-3-heptanone. Continuing the steam distillation until 5-methyl-3-heptanone no longer co-distills assures complete removal of the Schiff's base from the product residue.

EXAMPLE 7

A 50 g. sample of N,N'-di(1-ethyl-3-methylpentylidene)-p-phenylenediamine IIId, equivalent to the Schiff's base IIIb prepared by the reaction of 5-methyl-3-heptanone with p-phenylenediamine was stripped with superheated steam (160° C.) as described in Example 2 until a 446 g. distillate was collected. The distillate contained 4.7 g. of an oil layer which was found to be primarily 5-methyl-3-heptanone.

It can be shown that the well known oil additive and elastomer antiozonant, N,N'-bis(1-ethyl-3-methylpentyl)-p-phenylenediamine contains varying amounts of mono-Schiff's base IIIc and di-Schiff's base IIId respectively.

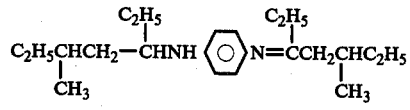
IIIc and

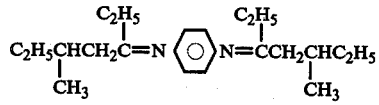
IIId

Example 7 demonstrated that when pure IIId is treated with steam, the N,N'-di(1-ethyl-3-methylpentylidene)-p-phenylenediamine hydrolizes to form 5-methyl-3-heptanone which codistills with the steam. Similarly, the steam distillation of Example 6 until no further 5-methyl-3-heptanone is co-distilled would provide a product residue which is free of not only the mono- and di-Schiff's bases, IIIc and IIId, respectively, but also of the ketone. Accordingly, the purified form of the N,N' disubstituted p-phenylenediamine oil additive would not be subject to degradation at ambient temperature and humidity since there would be no Schiff's base, ketone nor alcohol derivatives of the ketone present to lower the viscosity of the oil per se.

Although this invention has been described in considerable detail, such description is intended as being illustrative rather than limiting, since the invention may be variously embodied, and the scope of the invention is to be determined as claimed.

What is claimed is:

1. A process for purifying soft, mushy, crude N-(1,3-dimethylbutyl)-N'-phenyl-p-phenylenediamine prepared by reductive alkylation of N-phenyl-p-phenylenediamine with an excess of a 4-methyl-2-pentanone, and stripping off water, excess 4-methyl-2-pentanone and 4-methyl-2-pentanol; wherein the purification consists of (a) subjecting the crude reaction product to superheated steam stripping until a portion of the reaction product is removed such that the stripped residue comprises flakable N-(1,3-dimethylbutyl)-N'-phenyl-p-phenylenediamine, and (b) recovering the stripped residue as the final product.

2. The process of claim 1 in which the superheated steam stripping is conducted at a pot temperature of 102° C to 180° C.

3. The process of claim 1 wherein the steam stripping is conducted until about 1.6 per cent of the reaction product is stripped off.

* * * * *